US008417148B2

(12) United States Patent
Yamashita

(10) Patent No.: US 8,417,148 B2
(45) Date of Patent: Apr. 9, 2013

(54) IMAGE FORMING APPARATUS AND IMAGE FORMING METHOD

(75) Inventor: Toshimi Yamashita, Kanagawa-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/540,013

(22) Filed: Jul. 2, 2012

(65) Prior Publication Data

US 2012/0269546 A1 Oct. 25, 2012

Related U.S. Application Data

(60) Division of application No. 13/081,612, filed on Apr. 7, 2011, now Pat. No. 8,238,788, which is a continuation of application No. 12/100,508, filed on Apr. 10, 2008, now Pat. No. 7,945, 189.

(60) Provisional application No. 60/912,197, filed on Apr. 17, 2007.

(51) Int. Cl.
*G03G 15/01* (2006.01)
*G03G 13/01* (2006.01)

(52) U.S. Cl.
USPC ..... 399/113; 399/112

(58) Field of Classification Search ..... 399/112, 399/113
See application file for complete search history.

(56) References Cited

U.S. PATENT DOCUMENTS

| | | | |
|---|---|---|---|
| 5,572,311 | A | 11/1996 | Abe et al. |
| 7,945,189 | B2 | 5/2011 | Yamashita |
| 2006/0115283 | A1 | 6/2006 | Yamauchi et al. |
| 2006/0198649 | A1 | 9/2006 | Imamiya |
| 2008/0013970 | A1 | 1/2008 | Kikuchi |

OTHER PUBLICATIONS

United States Office Action for U.S. Appl. No. 13/081,612 mailed on Jul. 13, 2011.

*Primary Examiner* — Hoa V Le
(74) *Attorney, Agent, or Firm* — Turocy & Watson, LLP

(57) ABSTRACT

An image forming apparatus and an image forming method are provided that realize both the use of a decolorizing toner and a non-decolorizing toner and miniaturization of the apparatus.

13 Claims, 3 Drawing Sheets

IMAGE FORMING APPARATUS AND IMAGE FORMING METHOD

CROSS-REFERENCE TO RELATED APPLICATIONS

This application is a Divisional of application Ser. No. 13/081,612 filed on Apr. 7, 2011 which is a Continuation of application Ser. No. 12/100,508 filed on Apr. 10, 2008, which claims the benefit of priority from U.S. Provisional Ser. No. 60/912,197 filed on Apr. 17, 2007, the entire contents of each application are incorporated herein by reference.

BACKGROUND OF THE INVENTION

1. Field of the Invention

The present invention relates to an image forming apparatus and image forming method using a decolorizing toner.

2. Description of the Related Art

Recently, information is typically printed on paper and thus confirmed by the use of an image forming apparatus such as a copier, printer, facsimile, or multi-function peripheral (MFP) that integrates these. Because of the increase in the volume of information, the quantity of paper used has been increasing.

However, most of those printed documents contain records that are not required to be saved and are temporary. Therefore, these documents are disposed of in a short period. Meanwhile, as the awareness of the environment has increased such as conservation of forest resources as the material of paper and reduction in CO2 emission, using the back side of printed paper, double-side printing, using recycled paper and so on are common practices. Moreover, in order to enable repeated use of paper, techniques of mechanically or chemically stripping a toner from paper, and techniques of using a decolorizing toner that performs decolorization by heat, light or chemicals, for printing, have been known.

Printed documents using a decolorizing toner contain records that are not required to be saved for a long time and are temporary. These documents are not suitable for long-term saving. Therefore, a user who cares about environmental protection must use both an image forming apparatus that uses a decolorizing toner and an image forming apparatus that uses an ordinary non-decolorizing toner, and therefore the cost to purchase the two image forming apparatuses arises, and the place where the two image forming apparatuses can be installed, is required and so on.

SUMMARY OF THE INVENTION

An embodiment of the invention provides an image forming apparatus and an image forming method that can realize both the use of a decolorizing toner and a non-decolorizing toner and miniaturization of the apparatus.

To solve the above problem, an image forming apparatus according to an aspect of the invention uses an intermediate transfer system. The apparatus includes: a primary transfer member that carries a transferred toner image; a decolorizing toner process unit that is a process unit configured to form a toner image with a decolorizing toner and transfer the decolorizing toner image to the primary transfer member; a non-decolorizing toner process unit that is a process unit arranged downstream from the decolorizing toner process unit in a traveling direction of the toner image on the primary transfer member and configured to form a toner image with a non-decolorizing toner and transfer the non-decolorizing toner image to the primary transfer member; and a secondary transfer roller that is arranged downstream from the non-decolorizing toner process unit in the traveling direction of the toner image on the primary transfer member and transfers the toner image on the primary transfer member to a sheet.

An image forming method according to another aspect of the invention uses an intermediate transfer system. The method includes: forming a toner image with a decolorizing toner and transferring the decolorizing toner image to a primary transfer member by a decolorizing toner process unit; forming a toner image with a non-decolorizing toner and transferring the non-decolorizing toner image to the primary transfer member by a non-decolorizing toner process unit arranged downstream from the decolorizing toner process unit in a traveling direction of a toner image on the primary transfer member; and transferring the toner image on the primary transfer member to a sheet by a secondary transfer roller arranged downstream from the non-decolorizing toner process unit in the traveling direction of the toner image on the primary transfer member.

DESCRIPTION OF THE EMBODIMENTS

Hereinafter, embodiments of the invention will be described with reference to the drawings.

In the case where a developing device having a decolorizing toner and plural developing devices having a non-decolorizing toner are provided in one image forming apparatus, the size of the image forming apparatus increases. If color printing is necessary, the size of the image forming apparatus increases further.

An image forming apparatus according to this embodiment is an image forming apparatus that carries out color printing and uses a tandem cleanerless process in order to realize a compact size.

Figure 1:
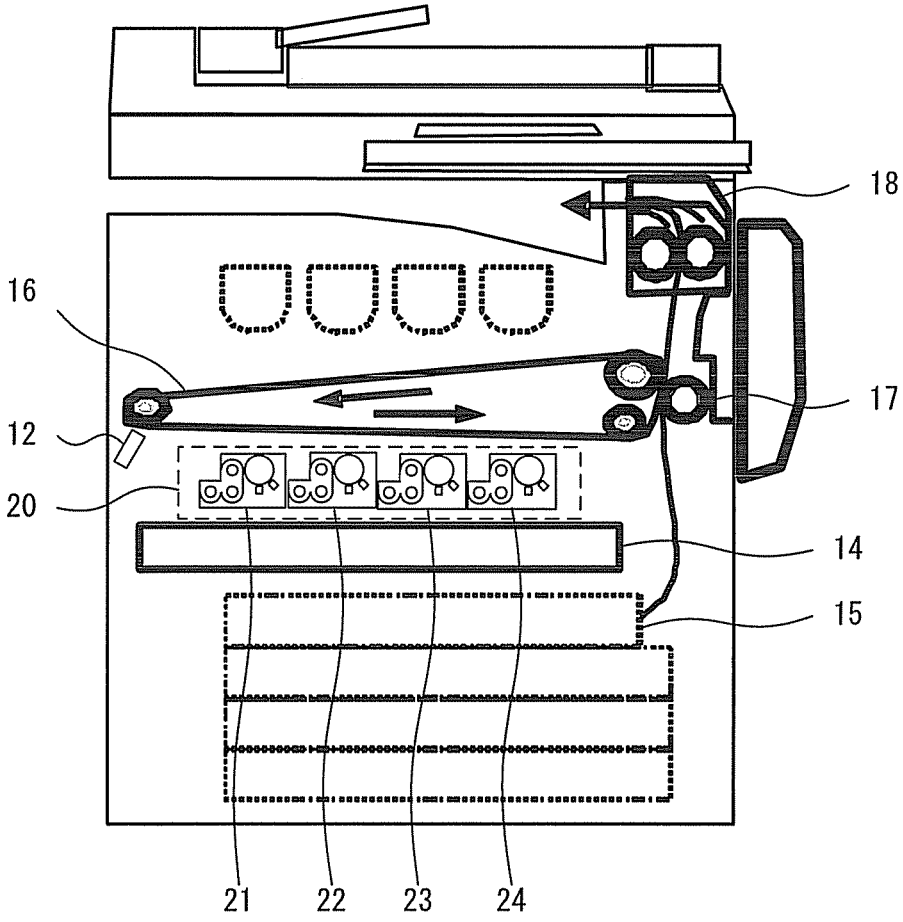
FIG. 1 is a configuration view showing an exemplary configuration of an image forming apparatus employing a tandem cleanerless process.

FIG. 1 is a configuration view showing an exemplary configuration of the image forming apparatus using a tandem cleanerless process. This image forming apparatus has a tandem cleanerless process 20, a blade 12 (toner removing part), a control device 14, a paper feed device 15, a primary transfer belt 16, a secondary transfer roller 17, and a fixing device 18.

The tandem cleanerless process 20 has four process units 21, 22, 23 and 24. When forming an image, all the process units contact the primary transfer belt 16.

Figure 2:
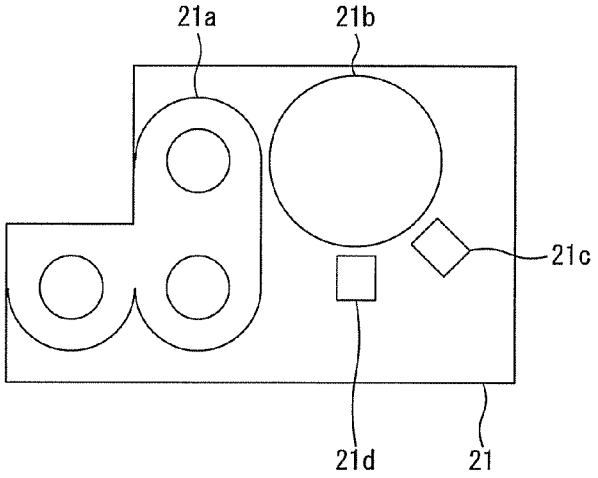
FIG. 2 is a configuration view showing an exemplary configuration of a process unit.

FIG. 2 is a configuration view showing an exemplary configuration of a process unit. The process unit 21 has a developing device 21*a*, a photoconductive drum 21*b*, a charging device 21*c*, and an exposure device 21*d*. In the process unit 21, the photoconductive drum 21*b* (image carrier) is charged to a predetermined potential by the charging device 21*c* and is irradiated with a laser beam with its intensity modified according to image information by the exposure device 21*d*. Thus, an electrostatic latent image corresponding to an image to be outputted is formed on the photoconductive drum 21*b*.

The electrostatic latent image formed on the photoconductive drum 21*b* is developed with a selectively provided toner by a magnetic brush of the developing device 21*a*. The developed toner on the photoconductive drum 21*b* is transferred to the primary transfer belt 16 by an electric field. The other process units 22, 23 and 24 operate in the same manner. The process units 21, 22, 23 and 24 do not have a cleaning device (cleaner) for cleaning a residual transfer toner and a reverse transfer toner on the photoconductive drum.

Figure 3:
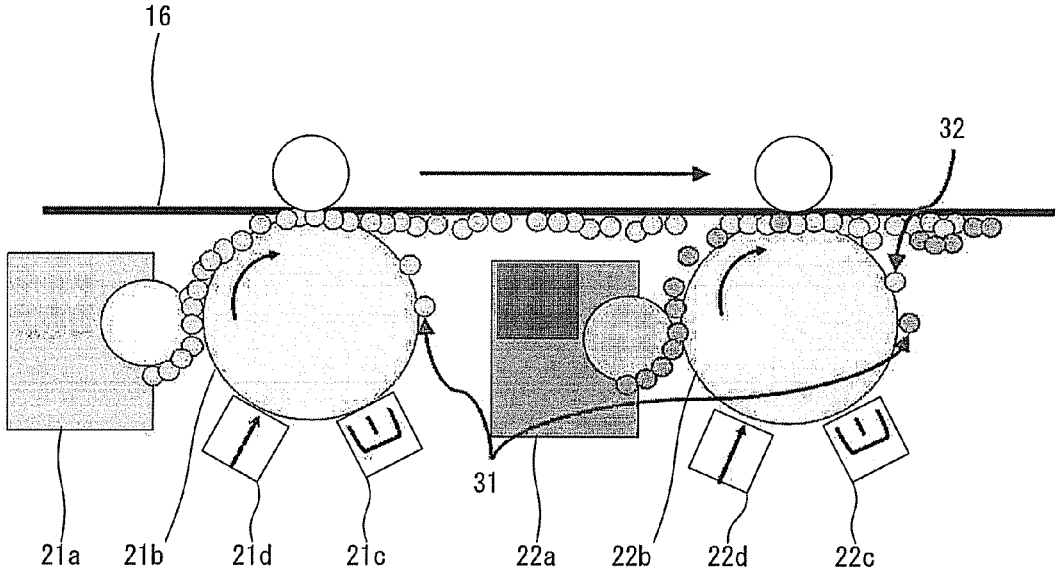
FIG. 3 is a conceptual view showing an exemplary state of residual transfer and reverse transfer in the tandem cleanerless process.

FIG. 3 is a conceptual view showing an exemplary state of residual transfer and reverse transfer in the tandem cleanerless process. The arrow above the primary transfer belt 16 indicates the progressing direction of the process and the traveling direction of a toner image on the primary transfer belt 16. FIG. 3 also shows the operation of the process units 21 and 22. Similarly to the above-described process unit 21, the process unit 22 has a developing device 22*a*, a photoconductive drum 22*b*, a charging device 22*c*, and an exposure device 22*d*.

A residual transfer toner 31 on the photoconductive drum 21*b* is carried again into the developing area through the next image creation process (neutralization, charging, and exposure). Of this residual transfer toner, the residual transfer toner that exists in a non-image part of a new latent image is collected into the developing device 21*a* by a magnetic brush. The residual transfer toner that exists in an image part is eventually transferred to the primary transfer belt 16 together with the toner that is newly supplied from the developing device 21*a*.

Here, reverse transfer occurs, that is, the toner transferred to the primary transfer belt 16 from the photoconductive drum 21*b* of the process unit 21 situated upstream in the progressing direction of the process is transferred to the photoconductive drum 22*b* of the process unit 22 situated downstream. Thus, a reverse transfer toner 32 from the process unit 21 is mixed with the color of the toner of the process unit 22.

In this case, if the upstream process unit 21 is a non-decolorizing toner process unit and the downstream process unit 22 is a decolorizing toner process unit, the non-decolorizing toner is mixed with the decolorizing toner. Moreover, additives such as lubricant which are added to the toner to extend the life of the photoconductor and to improve the cleaning characteristic may cause adverse effects including deterioration in decolorization (the color cannot be easily erased) and reduction in the quantity of charges. Therefore, such additives cannot be added to the decolorizing toner. Thus, the decolorizing toner tends to have a poorer cleaning characteristic than the non-decolorizing toner and reverse transfer tends to occur.

In this way, if printing is carried out with the decolorizing toner to erase the print on the sheet with the decolorizing toner in the state where the other non-decolorizing toner is mixed with the color of the process unit using the decolorizing toner, the mixed non-decolorizing toner remains and a non-erased part is generated.

The image forming apparatus according to this embodiment has the tandem cleanerless process in order to prevent the occurrence of the above problem.

Figure 4:
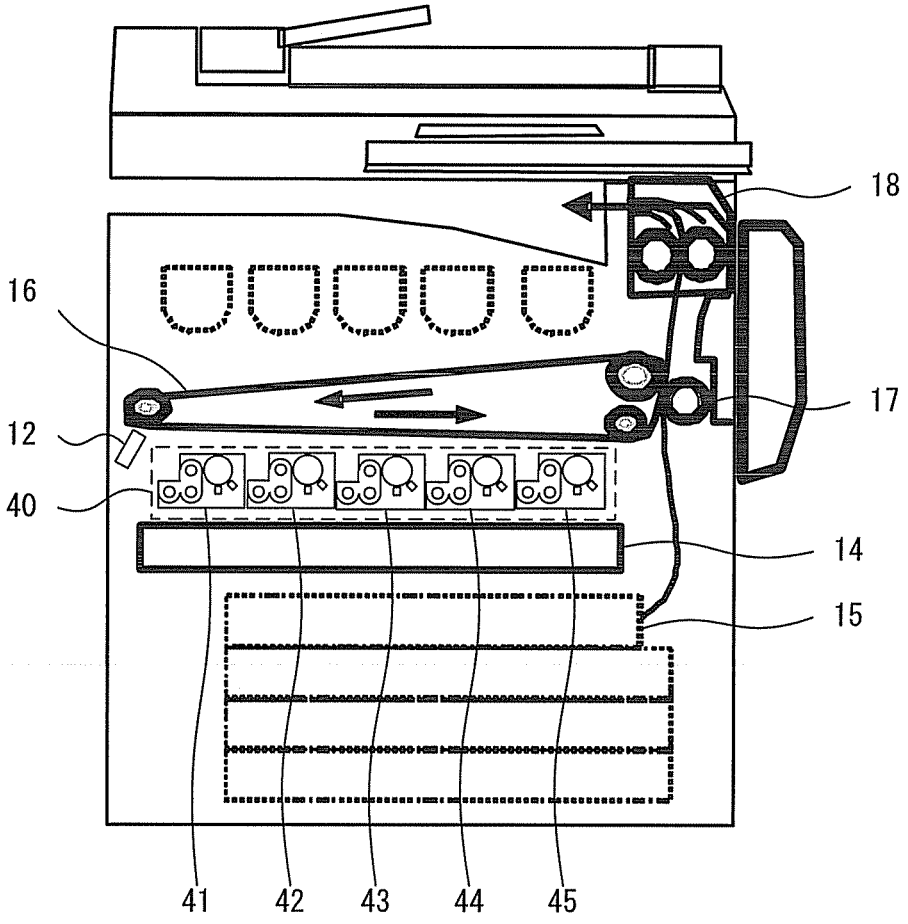
FIG. 4 is a configuration view showing an exemplary configuration of an image forming apparatus according to the embodiment.

FIG. 4 is a configuration view showing an exemplary configuration of the image forming apparatus according to this embodiment. In FIG. 4, the same reference numerals as in FIG. 1 denote the same or equivalent objects as shown in FIG. 1 and therefore will not be described further in detail. Compared to the image forming apparatus of FIG. 1, the image forming apparatus of FIG. 4 has a tandem cleanerless process 40 instead of the tandem cleanerless process 20.

This tandem cleanerless process 40 includes a decolorizing toner process unit 41 of one color and non-decolorizing toner process units 42, 43, 44 and 45 of four colors. The decolorizing toner process unit 41 is arranged on the most upstream side. The yellow process unit 42 of a non-decolorizing toner is arranged downstream of the process unit 41. The magenta process unit 43 of a non-decolorizing toner is arranged downstream of the process unit 42. The cyan process unit 44 of a non-decolorizing toner is arranged downstream of the process unit 43. The black process unit 45 of a non-decolorizing toner is arranged downstream of the process unit 44. When forming an image, all the process units 41, 42, 43, 44 and 45 contact the primary transfer belt 16.

In the case of printing with the decolorizing toner, the image creation process by the non-decolorizing toner process units 42, 43, 44 and 45 is not carried out. The decolorizing toner on the primary transfer belt 16 is transferred to a transfer sheet carried from the paper feed device 15, by the secondary transfer roller 17. The decolorizing toner transferred to the transfer sheet is carried to the fixing device 16 and fixed to the transfer sheet as it is melted by the fixing device 16. Then, the sheet is discharged from the image forming apparatus.

On the other hand, in the case of printing with the non-decolorizing toner, the image creation process by the decolorizing toner process unit 41 is not carried out. The toner of each color is transferred to the primary transfer belt 16 through the image creation process by the yellow process unit 42, the magenta process unit 43, the cyan process unit 44, and the black process unit 45. After that, paper feeding, a secondary transfer process by the secondary transfer roller 17, and a fixing process by the fixing device 16 are carried out. Then, the sheet is discharged from the image forming apparatus.

The toner remaining on the primary transfer belt 16 after passing the secondary transfer roller 17 is removed by the blade 12 that contacts the primary transfer belt 16 on the roller before entering the tandem cleanerless process 40.

In the image forming apparatus according to this embodiment, plural decolorizing toners of different colors from each other or plural decolorizing toners having different erasing methods from each other may be provided. The tandem cleanerless process in such cases has plural decolorizing toner process units. Moreover, all the decolorizing toner process units are arranged upstream from all the non-decolorizing toner process units in the progressing direction of the process.

According to this embodiment, in the case where a tandem cleanerless process is configured with the use of both a decolorizing toner and a non-decolorizing toner, the non-decolorizing toner can be prevented from being mixed with the toner of the decolorizing toner process unit. Thus, the problem that a non-erased part is generated by the remaining mixed non-decolorizing toner can be avoided when the print on a sheet is erased with the decolorizing toner. The user does not have to install both an image forming apparatus for a decolorizing toner only and an ordinary image forming apparatus for non-decolorizing toners only. The user only has to install one image forming apparatus according to this embodiment. Therefore, the cost to purchase the image forming apparatus and the space where the image forming apparatus can be installed can be reduced.

Moreover, even when the decolorizing toner process unit and the non-decolorizing toner process unit are simultaneously in contact with the primary transfer belt in the tandem cleanerless process, the non-decolorizing toner can be prevented from being mixed with the decolorizing toner. Therefore, the contact of the decolorizing toner process unit to the primary transfer belt and the contact of the non-decolorizing toner process unit to the primary transfer belt need not be controlled separately. Thus, higher speed and lower cost can be realized.

The specific embodiments of the invention have been described in detail. However, it will be obvious to those skilled in the art that various changes and modifications can be made without departing from the scope and spirit of the invention.

What is claimed is:

1. An image forming apparatus, comprising:

a first printing unit configured to print a first image with decolorable colorant; and a second printing unit configured to print a second image with non-decolorable colorant and further comprises:

a plurality of printing sub-units each of which is configured to print the second image with a different color of non-decolorable colorant; and a printing sub-unit, downstream of the plurality of printing sub-units in a moving direction of a transfer surface, configured to print the second image using black non-decolorable colorant.

2. The image forming apparatus of claim 1, wherein the first printing unit is in contact with the transfer surface and the second printing unit is in contact with the transfer surface.

3. The image forming apparatus of claim 2, wherein the first printing unit comprises a first photoconductor on which a first electrostatic latent image is formed and a first developing device configured to develop the first electrostatic latent image on the first photoconductor with the decolorable colorant, and each printing sub-unit comprises a second photoconductor on which a second electrostatic latent image is formed and a second developing device configured to develop the second electrostatic latent image on the second photoconductor with the non-decolorable colorant.

4. The image forming apparatus of claim 2, wherein the decolorable colorant decolorizes in response to application of heat.

5. The image forming apparatus of claim 2, wherein the first printing unit and the second printing unit print the first and the second images to a sheet on the transfer surface.

6. The apparatus of claim 2, wherein the first printing unit and the second printing unit print the first and the second images to the transfer surface which transfers the images to a sheet.

7. The image forming apparatus of claim 2, further comprising a controller that forms an image with the non-decolorable colorant and not the decolorable colorant using only the second printing unit in response to receiving a print instruction for non-decolorable colorant.

8. The image forming apparatus of claim 2, further comprising a controller that forms an image with the decolorable colorant and not the non-decolorable colorant using only the first printing unit in response to receiving a print instruction for decolorable colorant.

9. An image forming method, comprising:

printing a first image with decolorable colorant to a transfer surface; and printing a second image with non-decolorable colorant to the transfer surface, wherein the printing a second image comprises printing with a plurality of colors of non-decolorable colorant and printing with a black non-decolorable colorant downstream in a moving direction of the transfer surface of the printing with a plurality of colors.

10. The image forming method of claim 9, wherein the printing a first image comprises bringing a first printing unit configured to print the first image with decolorable colorant into contact with the transfer surface, and the printing a second image comprises bringing a second printing unit configured to print the second image with non-decolorable colorant into contact with the transfer surface.

11. The image forming method of claim 10, further comprising transferring the first and the second images to a sheet via the transfer surface.

12. The image forming method of claim 10, further comprising transferring the first and the second images to a sheet on the transfer surface.

13. The image forming method of claim 10, further comprising forming an image with the non-decolorable colorant and not the decolorable colorant in response to receiving a print instruction for the non-decolorable colorant.

* * * * *